United States Patent [19]

Hughes et al.

[11] Patent Number: 4,962,719

[45] Date of Patent: Oct. 16, 1990

[54] PROTECTIVE BOAT HULL DEVICE

[76] Inventors: Timothy R. Hughes, Rte. 5, Box 604, Reeds Spring, Mo. 65737; Theodore A. Siebert, Jr., P.O. Box 7026, St. Louis, Mo. 63177

[21] Appl. No.: 333,533

[22] Filed: Apr. 5, 1989

[51] Int. Cl.[5] ..... B63B 43/00

[52] U.S. Cl. ..... 114/343; 114/361; 114/364

[58] Field of Search ..... 114/343, 361, 219, 221 R, 114/364

[56] References Cited

U.S. PATENT DOCUMENTS

| | | | |
|---|---|---|---|
| 3,055,022 | 9/1962 | Vallquist | 114/343 |
| 3,220,026 | 11/1965 | Lichti | 114/343 |
| 3,587,123 | 6/1971 | O'Boyle | 114/364 |
| 4,815,412 | 3/1989 | Cassaro, Jr. | 114/219 |

*Primary Examiner*—Joseph F. Peters, Jr.
*Assistant Examiner*—Jesûs D. Sotelo
*Attorney, Agent, or Firm*—Polster, Polster and Lucchesi

[57] ABSTRACT

A protective boat hull device is disclosed to prevent damage to a boat hull during beaching. An elongated flexible and waterproof sheet is provided having a length substantially greater than the width thereof, and capable of being wound into a roll along the elongated length thereof for storage purposes. The sheet includes a centering notch extending across the width of one end of the sheet for engaging the front hull of the boat above the water line, in order to center the sheet underneath the hull of the boat below the water line and prevent hull damage during beaching of the boat. The sheet further includes fastening means to facilitate attachment and detachment of the sheet relative to the boat.

11 Claims, 3 Drawing Sheets

PROTECTIVE BOAT HULL DEVICE

BACKGROUND OF THE INVENTION

Pleasure boats especially fishing boats have seen a dramatic increase over the past several years as a result of more leisure time being available for people who enjoy activities associated with water and water sports. At the same time, the price of boats has increased, as well. For example, the average bass fishing boat can cost anywhere from $5,000 to $25,000 which, as can be appreciated, is a very substantial investment. As a result, boat owners are motivated to protect their boats not only from the standpoint of use, but also from an investment viewpoint.

One of the problems associated with boat use involves the beaching of boats. The shoreline is dotted with rocks, and there are numerous opportunities to scratch or otherwise damage the hull of the boat when the boat is beached, as is common in picnicing, camping, trailering and in fishing tournaments. In the latter situation, boats are beached at fishing tournament weigh-ins. Because of the possibility of damage to the hull of the boat, some fisherman keep their boats off the shore in several feet of water, while a fishing partner leaves the boat in order to weigh the fish on the shore. At the present time, this is the only way that fishermen can keep the boat hull from being damaged. Scratches and other damage to the hull of a boat can greatly depreciate the trade-in or re-sale value of the boat, not to mention the unsightliness and the potential for interfering with the speed and/or operation of the boat.

There have been other protective hull safety covers developed in the past, such as U.S. Pat. No. 4,026,233 which comprises a loose fitting cover or sheet that is draped underneath the entire hull of a boat to prevent water damage to a damaged boat when moving the boat. However, this patented device requires fastening completely around the boat and does not facilitate convenient use and storage, which would be desirable for a protective device during repeated boat beaching.

The present invention is a new and imroved protective boat hull device which overcomes many of the aforementioned disadvantages, while enabling the boat owner to enjoy the beauty and operation of his/her boat.

SUMMARY OF THE INVENTION

Among the several objects and advantages of the present invention include:

The provision of a protective boat hull device which overcomes problems associated with beaching a boat;

The provision of the aforementioned protective boat hull device which prevents damage to the hull of a boat;

The provision of the aforementioned protective boat hull device which can be easily wound into a roll for storage purposes and then unwound, when necessary, to protect the hull of a boat during beaching;

The provision of the aforementioned protective boat hull device which includes a centering notch to facilitate centering of the protective boat hull device relative to the boat hull;

The provision of the aforementioned protective boat hull device which includes fastening means to facilitate attachment and detachment of the protective boat hull device to a boat;

The provision of the aforementioned protective boat hull device which includes a flexible and waterproof protected sheet that provides protection to the boat hull prior to, during and after beaching of a boat; and The provision of the aforementioned protective boat hull device which is easy and economical to manufacture, is simple and easy to operate and install, when desired; is quickly and easily attached and detached relative to a boat; provides substantial protection to an expensive boat at a modest or minimal cost; and is otherwise well adapted for the purposes intended.

Briefly stated, the protective boat hull device of the present invention is constructed to prevent damage to the hull of a boat during beaching and includes an elongated flexible and waterproof sheet having a length substantially greater than the width thereof. The sheet is capable of being wound into a roll along the elongated length thereof for storage purposes and can be quickly unwound, when it is desired to use same. The sheet further includes a centering notch extending across the width of one end of the sheet for engaging the front eye hook (see FIG. 1) of the boat above the water in order to center the sheet underneath the hull of the boat below the water line and prevent hull damage during beaching of the boat. The sheet also includes fastening means for attaching the sheet to the boat.

The sheet is preferably made from durable waterproof rubber material, such as RVK90 white cover X friction surface conveyor belting polyvinyl chloride and polyester fabric. The centering notch comprises a V-shaped notch (with hole at bottom of the V-shaped notch) which engages the front eye hook of a boat above the water line. Cord elements are formed from stretchable material to enable the sheet to be tightly drawn to the boat hull in the vicinity of the centering notch. The fastening means further includes metal grommets attached to the sheet adjacent the centering notch on opposite sides of the sheet, and the stretchable cord elements include rubber coated hooks for fastening and detaching to front pedestal post or rope cleats. The other end of stretch cord is inserted through a $\frac{3}{8}''$ brass grommet which is pressed into protective boat hull device, and stretch cord is then tied into a knot.

The sheet preferably has a length of approximately 9′ and a width of approximately 30″. The brass grommets are approximately $\frac{3}{4}''$ O.D. $\times \frac{3}{8}''$ I.D. in diameter and are pressed in the sheet adjacent the centering notch as part of the fastening means.

These and other objects and advantages of the present invention will become more apparent from the ensuing description.

BRIEF DESCRIPTION OF THE DRAWINGS

In the drawings.

Corresponding reference numerals will be used throughout the various figures of the drawings.

DESCRIPTION OF THE PREFERRED EMBODIMENT

Figure 1:
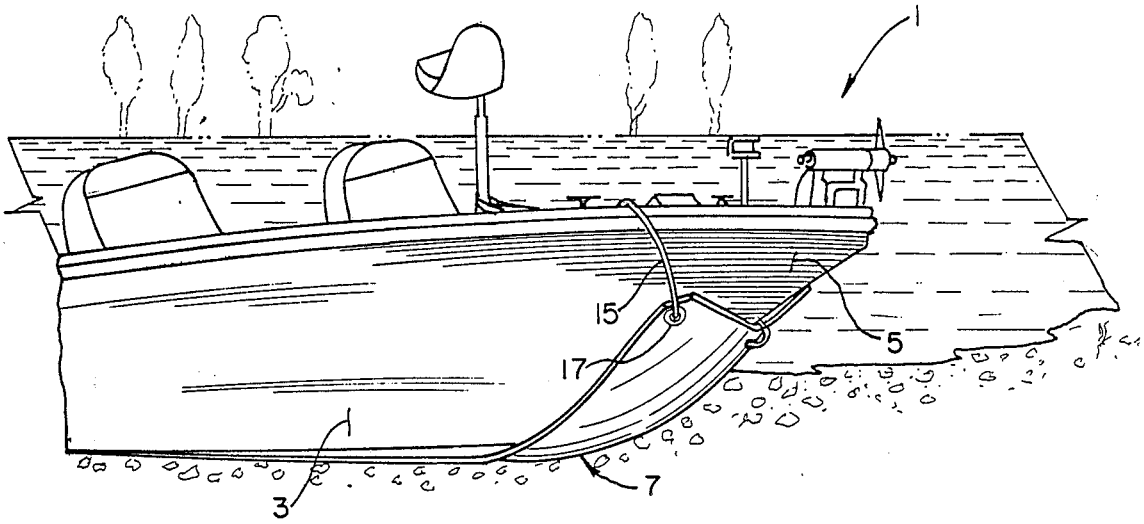
FIG. 1 is a fragmentary perspective view illustrating the protective boat hull device of the present invention mounted along the hull of a boat that is beached on a shore line adjacent a body of water.

The following detailed description illustrates the invention by way of example, and not by way of limitation. This description will clearly enable one skilled in the art to make and use the invention, and describes several embodiments, adaptions, variations, alternatives and uses of the invention, including what we presently believe to be the best mode of carrying out the invention.

In the drawings, the protective boat hull device of the present invention is shown as used in conjunction with a bass fishing boat, although it will be understood that the protective boat hull device may also be used with other types of pleasure boats and water craft where it is necessary to protect a boat hull during beaching of the boat.

The bass fishing boat 1 illustrated in the drawings includes a boat hull 3 and a front bow 5, as is typical with all types of boats and water craft. The bass fishing boat 1 is outfitted with various equipment including fisherman seats, trolling motors, etc., which explains, in part, the reason for the high cost of such boats.

Figure 2:
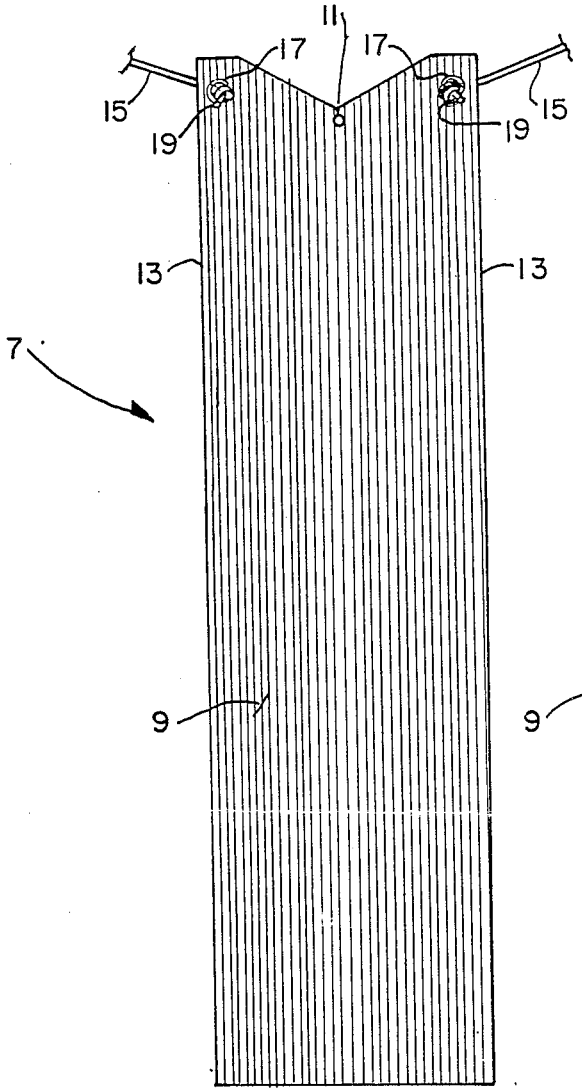
FIG. 2 is a fragmentary top plan view of the protective boat hull device including fastening elements thereof.
Figure 3:
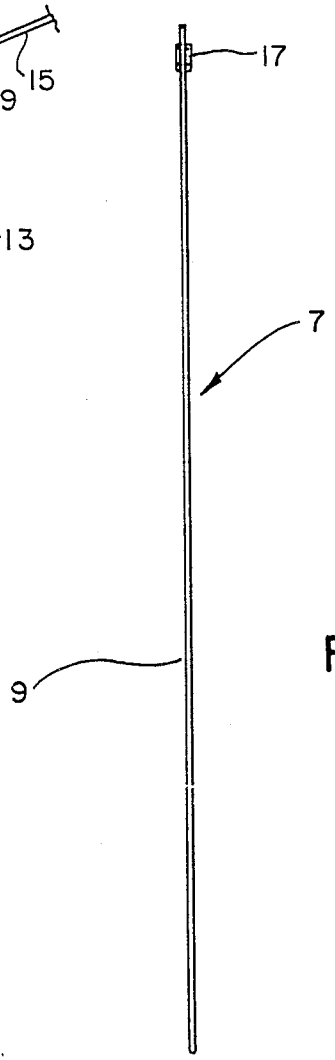
FIG. 3 is a side elevational view of the protective boat hull device as shown in FIG. 2.
Figure 7:
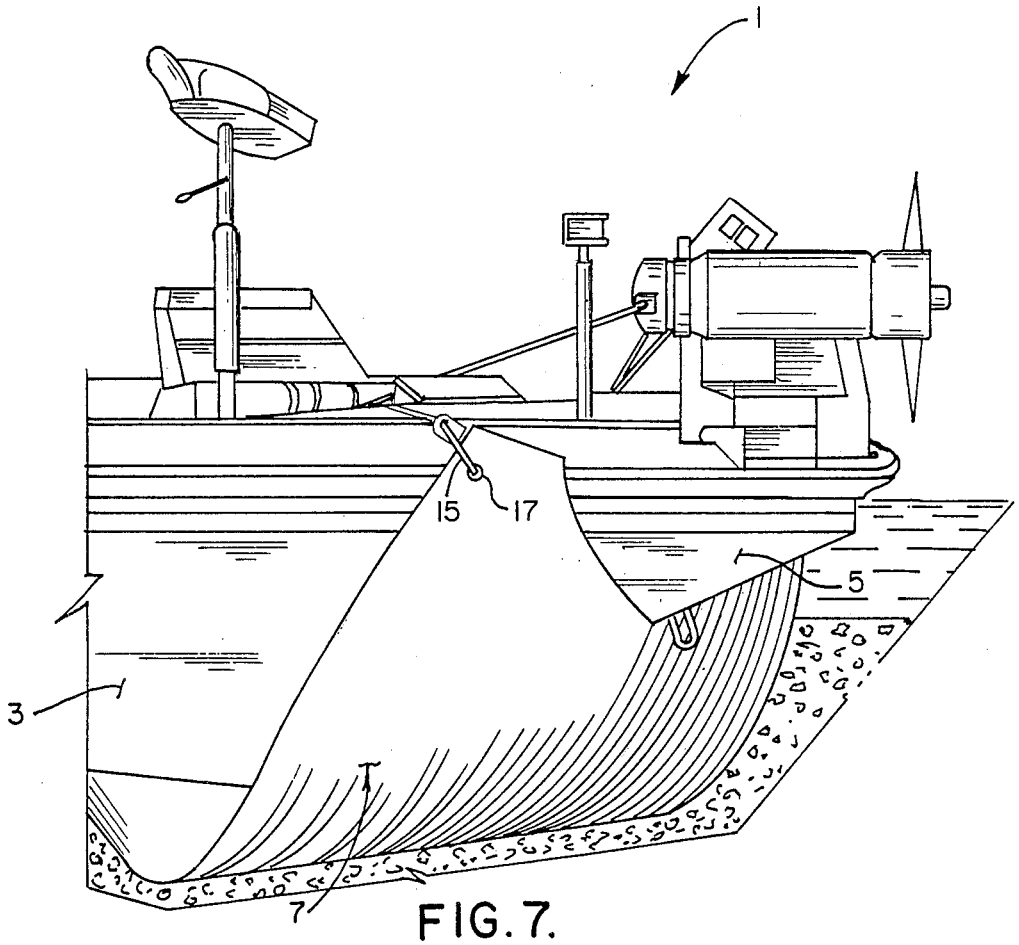
FIG. 7 is a fragmentary perspective view of the protective boat hull device mounted relative to the front hull of the boat and extending underneath the boat hull, while the boat is beached on a shore line.

In order to protect the hull of the boat 1 when beaching the boat, such as shown in FIGS. 1 and 7 of the drawings, a protective boat hull device 7 is provided. As best seen in FIGS. 2–3 of the drawings, the protective boat hull device 7 comprises an elongated flexible and waterproof sheet, preferably made from durable waterproof rubber material, such as RVK90 white cover X friction surface convey or belting polyvinyl chloride and polyester fabric, for ease and economy of manufacture, as well as durability of use. Specifically, the elongated flexible and waterproof sheet 9 is shown in FIGS. 2–3 of the drawings as having a length substantially greater than the width thereof. In actual practice, it has been discovered that for most boat sizes, a protective boat hull device 7 having a length of approximately 9′ and a width of approximately 30″ will protect the hull areas of most boats that are subjected to potential damage, including scratching or marring, when beached.

Figure 4:
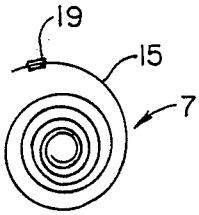
FIG. 4 is an end elevational view of the protective boat hull in a rolled up storage position.

Because the elongated flexible and waterproof sheet 9 is made from a rubber material, it is capable of being wound into a roll along the elongated length thereof, as shown in FIG. 4 of the drawings. As will be appreciated, the storage of the protective boat hull device 7 is an important convenience feature to users since they will be able to quickly and easily store same until it is ready for use.

The elongated sheet 9 of the protective boat hull device 7 includes centering means which extends across the width at one end of the sheet 9. Specifically, the centering means comprises a V-shaped notch 11 that extends across the width at one end of the sheet 9. The purpose of the centering means, in the form of the V-shaped notch 11, is to engage the front eye hook on bow 5 of the boat 1 above the water line, while the boat 1 is in the water, thus enabling the remainder of the elongated sheet 9 to be centered underneath the hull 3 of the boat 1 below the water line, so as to prevent hull damage during beaching of the boat 1.

Figure 8:
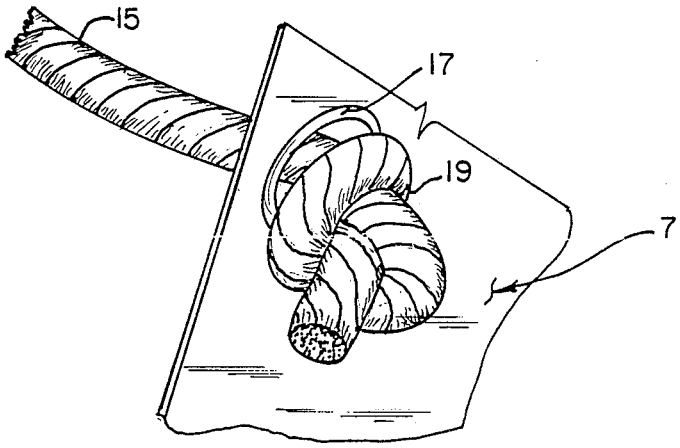
FIG. 8 is a fragmentary perspective view illustrating the stretchable cord elements and an associated rubber hook mounted in a metal grommet secured to the elongated sheet of the protective boat hull device.

For attaching and detaching the protective boat hull device 7 relative to the boat 1, fastening means are provided. Fastening means includes 3 foot stretchable cord elements 15, 15 which are attached to the elongated sheet 9 adjacent the V-shaped centering notch 11 to facilitate centering of the protective boat hull device 7 relative to the boat 1, as will be described below. The fastening means further includes brass grommets 17, 17 which are pressed into the elongated sheet 9 and receive the outer free end of each stretchable cord element which is then tied into a knot (see FIG. 8). In this connection, attention is directed to FIG. 8 of the drawings which shows, in an enlarged view, the construction and attachment of the outer free end of the stretchable cord element 15, and further illustrates the manner in which the stretchable cord is passed through the brass grommet and tied into a knot. In actual practice, it has been discovered that brass grommets of approximately $\frac{3}{4}$″ O.D.×$\frac{3}{8}$″ I.D. in diameter, together with suitably sized stretchable cord element are usefully employed, although other sizes and shapes may be used as found to be necessary.

Figure 5:
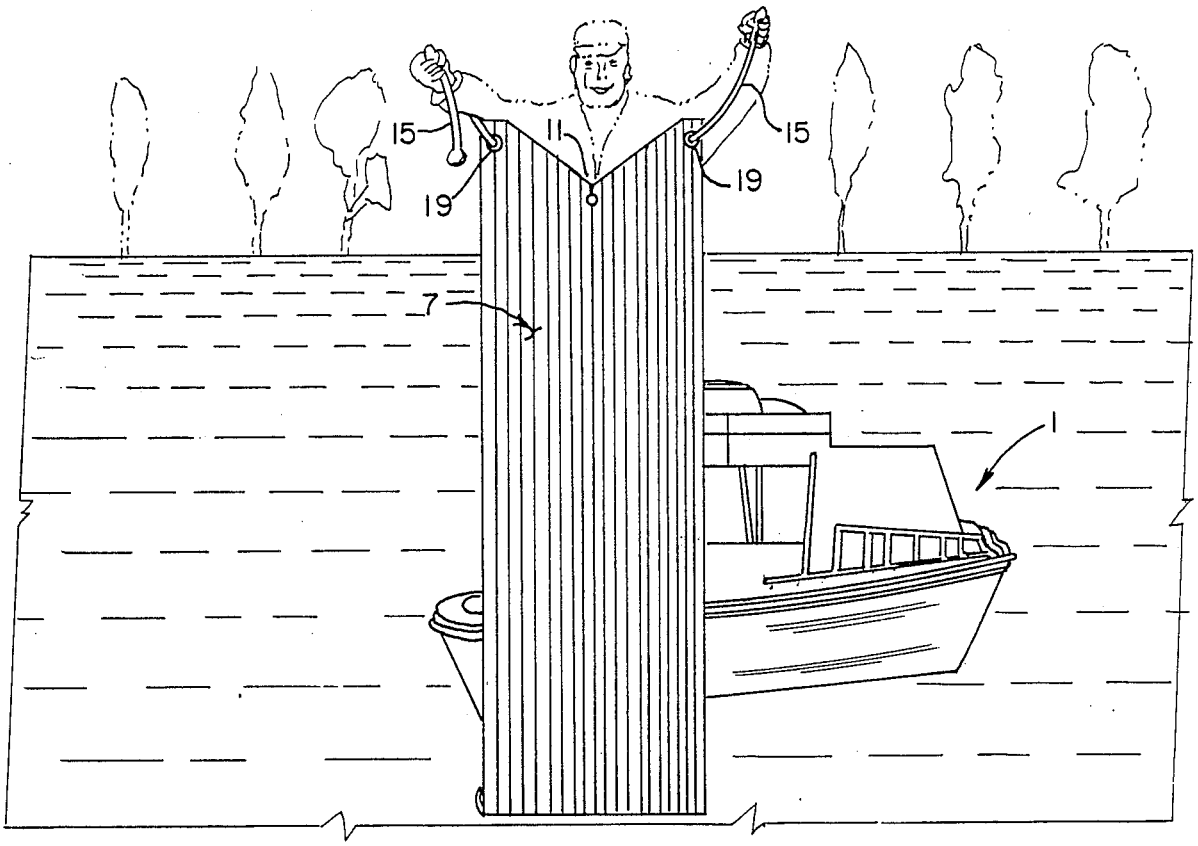
FIG. 5 is a perspective view illustrating the manner in which a user unrolls the protective boat hull device for use thereof.
Figure 6:
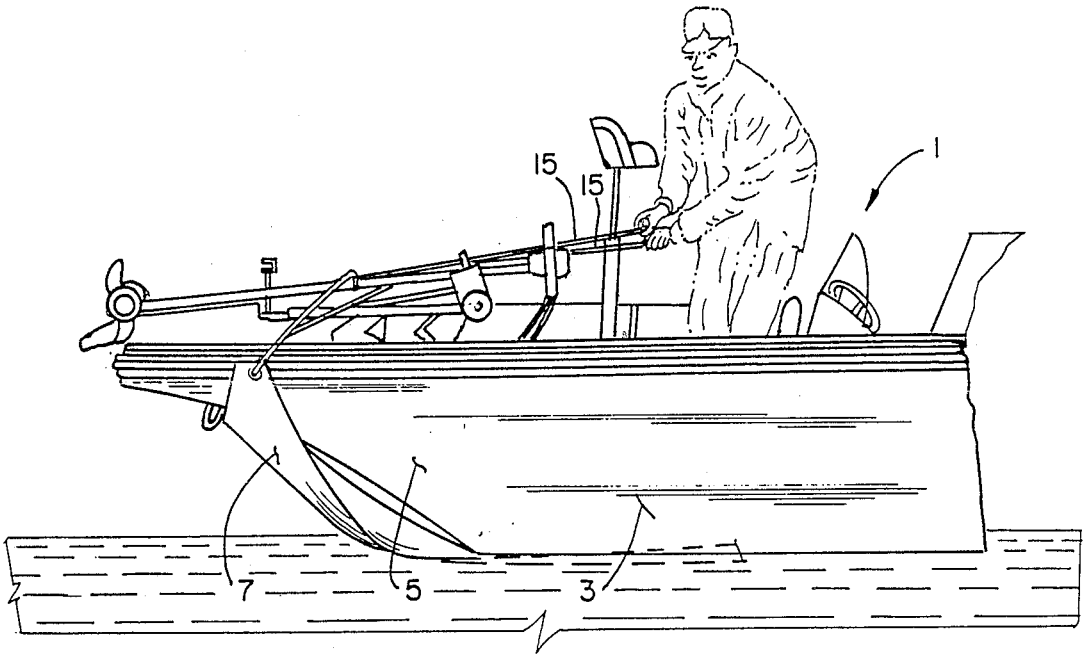
FIG. 6 is a fragmentary perspective view illustrating the manner in which the user mounts the protective boat hull device to the front hull of the boat above the water line.

The manner in which the protective boat hull device 7 is used in conjunction with a boat 1 will now be described. The first step in the use of the protective boat hull device 7 requires the unrolling of the device 7 from the storage condition shown in FIG. 4 to an unrolled condition, as demonstrated by the fisherman in FIG. 5 of the drawings. As will be noted, the fisherman has grasped the stretchable cord elements 15, 15, allowing the protective boat hull device 7 to unroll as illustrated. The fisherman could grasp any portion of the elongated sheet 9 for the same effect. The fisherman or other user will then lower the protective boat hull device 7 under the front bow 5 of the boat, as shown in FIG. 6 of the drawing, and thereafter pull up on the stretch cords 15 so as to cause the V-shaped centering notch 11 of the protective boat hull device 7 to engage the front bow 5 of the boat above the water line, as illustrated in FIG. 6 of the drawings. In addition to centering the protective boat hull device 7 relative to the front bow 5, the V-shaped centering notch 11 also enables the remaining portions of the elongated sheet 9 to be moved into a centering relationship relative to the boat hull 3, below the water line, as is also best seen in FIG. 6 of the drawings. The stretch cords 15, 15 are then hooked together around the front pedestal seat post, as the fisherman is demonstrating in FIG. 6 of the drawings, or alternatively, the stretch cords may be hooked into front rope cleats (not shown), as will be understood by boat users.

Following the mounting of the protective boat hull device 7 to the boat 1, the user may then move the boat, in an idled motor condition, to shore. The boat may then be beached, as is best illustrated in FIGS. 1 and 7 of the drawings, with the protective boat hull device 7 protecting the hull 3 of the boat 1 from scratching, marring or other damage caused by rocks or the like on the shore. Returning the boat 1 back to the water is an easy step, particularly with the protective boat hull device 7 protecting the hull, as the user will appreciate. Once the boat 1 is backed into the water, the protective boat hull device 7 may be unhooked from the boat 1 and then rolled up as shown in FIG. 4 of the drawing, and stored for future use.

From the foregoing, it will be appreciated that the protective boat hull device of the present invention provides a new and improved economical and convenient product for use by boat owners as a simple and effective way to prevent damage to boat hulls during beaching of boats.

In view of the above, it will be seen that the several objects of the invention are achieved and other advantageous results are obtained.

As various changes could be made in the above construction without departing from the scope of the invention, it is intended that all matter contained in the above description or shown in the accompanying drawings shall be interpreted as illustrative and not in a limiting sense.

We claim:

1. A protective boat hull device to prevent damage to the hull of a boat during beaching, comprising a one-piece elongated flexible and waterproof flat sheet having a length substantially greater than the width thereof, said sheet being capable of being wound into a roll along the elongated length thereof for storage purposes, said sheet having self-centering means extending across the width at one end of said sheet for engaging the front bow of the boat above the water line in order to center said sheet underneath the hull of the boat below the water line and prevent hull damage during beaching of the boat, said self-centering means including a V-shaped notch which extends inwardly within and across the width of the sheet at one end, said V-shaped notch being centered relative to the width of the sheet at one end of further including a connected opening at an innermost portion of said V-shaped notch for slidable assembly and complementary reception of a front eye hook on the front bow of the boat while surrounding material areas adjacent said V-shaped notch engage the front bow of the boat above the water line to provide self-centering alignment of the sheet relative to the boat below the water line, and said sheet having fastening means for attaching said sheet to said boat, said fastening means being attached to opposite sides of said sheet adjacent said V-shaped notch to facilitate centering of said sheet relative to said boat.

2. The protective boat hull device as defined in claim 1 wherein said sheet is made from durable waterproof rubber material.

3. The protective boat device as defined in claim 1 wherein an innermost portion of said V-shaped notch is generally aligned with fastening connections to said fastening means.

4. The protective boat hull device as defined in claim 3 wherein said fastening means includes one pair of spaced cord elements attached to said sheet adjacent said V-shaped centering notch to facilitate centering of said sheet relative to said boat hull.

5. The protective boat hull device as defined in claim 4 wherein said cord elements are formed from stretchable material to enable said sheet to be tightly drawn to said boat hull in the vicinity of said centering notch.

6. The protective boat hull device as defined in claim 5 wherein said fastening means further includes brass grommets attached to said sheet adjacent said centering notch on opposite sides of said sheet.

7. The protective boat hull device as defined in claim 6 wherein said stretchable cord elements include rubber coated hooks for releasable engagement with pedestal post or rope cleats provided on the boat.

8. The protective boat hull device as defined in claim 1 wherein said sheet has a length of approximately 9 feet and a width of approximately 30 inches.

9. The protective boat hull device as defined in claim 8 and including $\frac{3}{4}''$ outside diameter and $\frac{3}{8}''$ inside diameter brass grommets pressed in said sheet adjacent said centering means as part of said fastening means.

10. A protective boat hull device to prevent damage to the hull of a boat during beaching, comprising a one-piece elongated flexible and waterproof flat sheet having a length substantially greater than the width thereof, said sheet being capable of being wound into a roll along the elongated length thereof for storage purposes, said sheet having self-centering means extending across the width at one end of said sheet for engaging the front bow of the boat above the water line in order to center said sheet underneath the hull of the boat below the water line and prevent hull damage during beaching of the boat, said self-centering means including a V-shaped notch which extends inwardly within while also extending across the width of the sheet at one end, said V-shaped notch being centered relative to the width of the sheet at one end, surrounding material areas adjacent said V-shaped notch engaging the front bow of the boat above the water line to provide self-centering alignment of the sheet relative to the boat below the water line, said v-shaped notch includes a connected opening at an innermost portion of said v-shaped notch for slidable assembly and complementary reception of a front eye hook on the front bow of the boat to provide self-centering alignment of the sheet relative to the boat, and cord fastening means attached to opposite sides of said sheet adjacent said V-shaped notch for causing said surrounding material areas adjacent said V-shaped notch to engage the front bow of the boat and facilitates self-centering of said sheet relative to said boat.

11. The protective boat hull device as defined in claim 10 wherein said cord fastening means comprise stretchable cord elements for pulling said V-shaped notch into close conforming engagement with the front bow of the boat.

* * * * *